US007400082B2

(12) United States Patent
Suzuki et al.

(10) Patent No.: US 7,400,082 B2
(45) Date of Patent: Jul. 15, 2008

(54) LIGHT EMITTING SCREEN STRUCTURE AND IMAGE FORMING APPARATUS

(75) Inventors: Norihiro Suzuki, Kanagawa-Ken (JP); Koji Yamazaki, Kanagawa-Ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 461 days.

(21) Appl. No.: 11/271,898

(22) Filed: Nov. 14, 2005

(65) Prior Publication Data

US 2006/0103294 A1 May 18, 2006

(30) Foreign Application Priority Data

Nov. 18, 2004 (JP) ..... 2004-334071
Nov. 4, 2005 (JP) ..... 2005-320713

(51) Int. Cl.
*H01J 29/10* (2006.01)

(52) U.S. Cl. ..... 313/473; 313/496

(58) Field of Classification Search ..... 313/495, 313/496, 461, 473
See application file for complete search history.

(56) References Cited

U.S. PATENT DOCUMENTS

| | | | | |
|---|---|---|---|---|
| 6,225,749 | B1 | 5/2001 | Kobayashi et al. | 315/169.3 |
| 6,445,367 | B1 | 9/2002 | Suzuki et al. | 345/75.2 |
| 6,509,691 | B2 | 1/2003 | Yamazaki et al. | 315/169.3 |
| 6,534,924 | B1 | 3/2003 | Oguchi et al. | 315/169.1 |
| 6,677,706 | B1 | 1/2004 | Hara et al. | 313/496 |
| 6,853,148 | B2 | 2/2005 | Yamazaki et al. | 315/169.3 |
| 6,896,571 | B2 | 5/2005 | Mizuno et al. | 445/24 |
| 7,053,537 | B2 | 5/2006 | Hiroike et al. | 313/292 |
| 7,077,716 | B2 | 7/2006 | Mizuno et al. | 445/24 |
| 7,135,823 | B2 | 11/2006 | Suzuki et al. | 315/160 |
| 2005/0276096 | A1 | 12/2005 | Hara et al. | 365/158 |
| 2006/0001345 | A1 | 1/2006 | Yamazaki | 313/292 |
| 2006/0087248 | A1 | 4/2006 | Konishi et al. | 315/169.3 |
| 2006/0103293 | A1 | 5/2006 | Yamazaki | 313/495 |
| 2006/0141892 | A1 | 6/2006 | Hiroike et al. | 445/24 |

FOREIGN PATENT DOCUMENTS

| | | |
|---|---|---|
| EP | 0 866 491 A2 | 9/1998 |
| JP | 3199682 | 6/2001 |
| JP | 2004-47408 | 2/2004 |

*Primary Examiner*—Vip Patel
(74) *Attorney, Agent, or Firm*—Fitzpatrick, Cella, Harper & Scinto

(57) ABSTRACT

In a flat type image forming apparatus formed by electron emitting devices, the invention is to provide a light emitting substrate, capable of relaxing influence of an abnormal discharge on the electron emitting devices. On a glass substrate 1, a resistor member 4 extending in X- and Y-direction, and a black member 6 extending in X- and Y-directions are formed. Phosphors 5 are positioned in apertures of the black member 6, and are covered by metal backs 7 divided in X- and Y-directions. The metal backs 7 and the resistor member 4 are electrically connected through the black member 6, and the resistance between the metal backs 7 is defined by the resistor member 4 in the Y-direction in which the adjacent metal backs 7 have a wider gap than in the X-direction.

14 Claims, 8 Drawing Sheets

LIGHT EMITTING SCREEN STRUCTURE AND IMAGE FORMING APPARATUS

BACKGROUND OF THE INVENTION

1. Field of the Invention

The present invention relates to a light emitting screen structure (light emitting substrate) for constituting an image forming apparatus such as an image display apparatus in combination with an electron emitting device, and to an image forming apparatus utilizing such light emitting substrate.

2. Related Background Art

An electron emitting apparatus utilizing an electron emitting device has been applied for example to an image forming apparatus. For example, there is known a flat type electron beam display panel, formed by arranging an electron source substrate provided with a plurality of cold cathode electron emitting devices, and an anode substrate provided with a metal back or a transparent electrode for accelerating electrons emitted from the electron emitting devices, and a phosphor in a mutually opposed relationship and by evacuating a gap between such substrates. The flat type electron beam display panel can achieve a lighter weight and a larger image size in comparison with the currently popular cathode ray tube (CRT). Also it can provide a higher luminance and a higher quality in the image, in comparison with other flat display panels such as a liquid crystal flat display panel, a plasma display panel or an electroluminescent display.

In such image forming apparatus of the type in which a high voltage is applied between the cold cathode multi electron source and the aforementioned metal back or transparent electrode for accelerating the electrons, a higher voltage application is advantageous for maximizing the luminance of the emitted light. Also, in certain device types, the emitted electron beam diverges before reaching the counter electrode, so that a shorter distance between the electrodes is preferable for realizing a display of a high resolution.

In such configuration, however, as a high electric field is inevitably formed between the opposed electrodes, a discharge may be generated to destruct the electron emitting device. Also in case of such discharge, a current is generated in a concentrated manner thereby causing a light spot phenomenon in a part of the displayed image.

For avoiding such drawbacks, it is required to reduce the frequency of discharge or to render the destruction by discharge less possible.

The destruction by discharge is assumed to be caused by a large current concentrated in a single position within a short time resulting in a heat generation which destructs the electron emitting device, or by an instantaneous increase in the voltage on the electron emitting device, leading to the destruction of the electron emitting device.

For decreasing the current causing the destruction by discharge, there is conceived a method of serially limiting a limiting resistor between the anode electrode and the power source, as shown in FIG. 7. However, in case of connecting devices of 500 units in the vertical direction by 1000 units in the horizontal direction with row and column wirings and driving these elements in a line-sequential mode, about 1000 devices are simultaneously turned on and such method leads to following drawbacks.

As about 1000 devices are simultaneously turned on with an emission current assumed as 5 μA per device, there results a current of 0 to 5 mA flowing into the anode. In case of externally inserting a serial resistance of 1 MΩ to the anode as shown in FIG. 7 and applying a voltage of 10 kV to the anode, there results a voltage drop of 0 to 5 kV depending on the number of devices turned on simultaneously. As a result, there will result an unevenness in the luminance of 50% at maximum.

Also as a high voltage is applied to the opposed flat plates (face plate and rear plate) 71, 72, it is necessary to also consider a charge accumulated as a capacitor. For example, in case the cathode and the anode shown in FIG. 7 have an area of 100 $cm^2$ and a distance of 1 mm with a potential difference of 10 kV, the accumulated charge reaches $1\times10^{-6}$ coulomb which causes a current concentration of 1 A in one position even when it is discharged in 1 μsec. Such discharge current leads to the destruction of the devices, so that the configuration of FIG. 7 cannot provide a sufficient solution to the drawback even if the aforementioned unevenness in luminance is absent.

For these drawbacks, the present applicant proposed, in Patent Reference 1, to divide an electrode for voltage application in a non-parallel manner to the direction of a scanning wiring and to provide a resistor between the electrode and accelerating voltage application means, thereby suppressing a discharge current generated between the mutually opposed flat plates.

FIG. 8 shows an example thereof and FIG. 9 shows an equivalent circuit thereof. In the drawings, there are shown a divided electrode 81, a resistor 82, a high voltage terminal 83, a high resistance area 84, a common electrode 85, a face plate 91 and a rear plate 92. Each divided electrode 81 (for example formed by an ITO film) is connected at an end thereof with the common electrode 85 through the resistor 82 (for example formed by an NiO film) whereby a high voltage can be applied from the terminal 83. In this configuration, the electrode at the side of the face plate 91 shown in FIG. 9 is divided, and a high resistor R1 is inserted in each divided electrode to reduce the capacity of the capacitor thereby reducing a discharge current Ib2. It is thus made possible to reduce an increase in the device voltage by a discharge current and to alleviate the damage at the discharge.

Also Patent Reference 2 discloses a cold cathode field emission display apparatus satisfying a relation Va/Lg<1 (kV/μm) between an anode voltage Va and a gap Lg between the anode electrode units. It is proposed, by such configuration, to suppress a discharge among the anode electrode units at an abnormal discharge, thereby suppressing the magnitude of the discharge.

Patent Reference 1: Japanese Patent No. 3199682 (EP866491A)

Patent Reference 2: Japanese Patent Application Laid-open No. 2004-47408

As explained in the foregoing, in an image forming apparatus constituted with electron emitting devices, there is desired a further reduction of the discharge current in the light emitting substrate (anode substrate), in order to reduce the damage to the electron emitting device in case of an abnormal discharge. It is particularly desired, in case of an abnormal discharge between the anode and the cathode, to suppress a discharge secondarily generated between adjacent anode electrodes. On the other hand, it is desired to reduce a gap between the adjacent anode electrodes in order to obtain an image of a higher definition.

SUMMARY OF THE INVENTION

An object of the present invention is to provide a light emitting screen structure for further suppressing a discharge current, thereby relaxing an influence of an abnormal discharge to an electron emitting device and realizing a satisfactory durability and a long life in an image forming apparatus. In particular, the present invention is to provide a light emitting substrate structure capable of preventing an electrical destruction between anode electrodes without increasing a distance between the adjacent anode electrodes.

In a first aspect, the present invention is to provide a light emitting screen structure including:

a substrate;

plural light emitting members positioned in a pattern of rows and columns on the substrate;

plural conductors each of which covers at least one of the light emitting members and which are arranged at an interval to form a pattern of rows and columns; and a resistor member electrically connecting the plural conductors;

wherein the resistor member is formed in a lattice shape including row stripe portions extending in a row direction, column stripe portions extending in a column direction, and aperture portions positioned between the row stripe portions and the column stripe portions, and a gap of the conductors adjacent in the row direction is positioned in an aperture of the lattice shaped resistor.

In a second aspect, the present invention is to provide an image forming apparatus including plural electron emitting devices, an electron source substrate having a wiring for applying a voltage to the electron emitting device, and a light emitting screen structure provided with a light emitting member which emits a light by an irradiation of electrons emitted by the electron emitting devices, wherein the light emitting screen structure has a structure described in said light emitting screen structure (first aspect of the present invention).

DETAILED DESCRIPTION OF THE PREFERRED EMBODIMENTS

A light emitting substrate and an image forming apparatus of the present invention relates to a flat panel electron beam display apparatus. In particular, an electron beam display apparatus utilizing a field electron emitting device or a surface conduction electron emitting device is a preferred form of application of the present invention in that a high voltage is generally applied to an anode electrode.

At first a basic configuration of the light emitting substrate of the present invention will be explained with reference to FIGS. 1A and 1B.

Figure 1A:
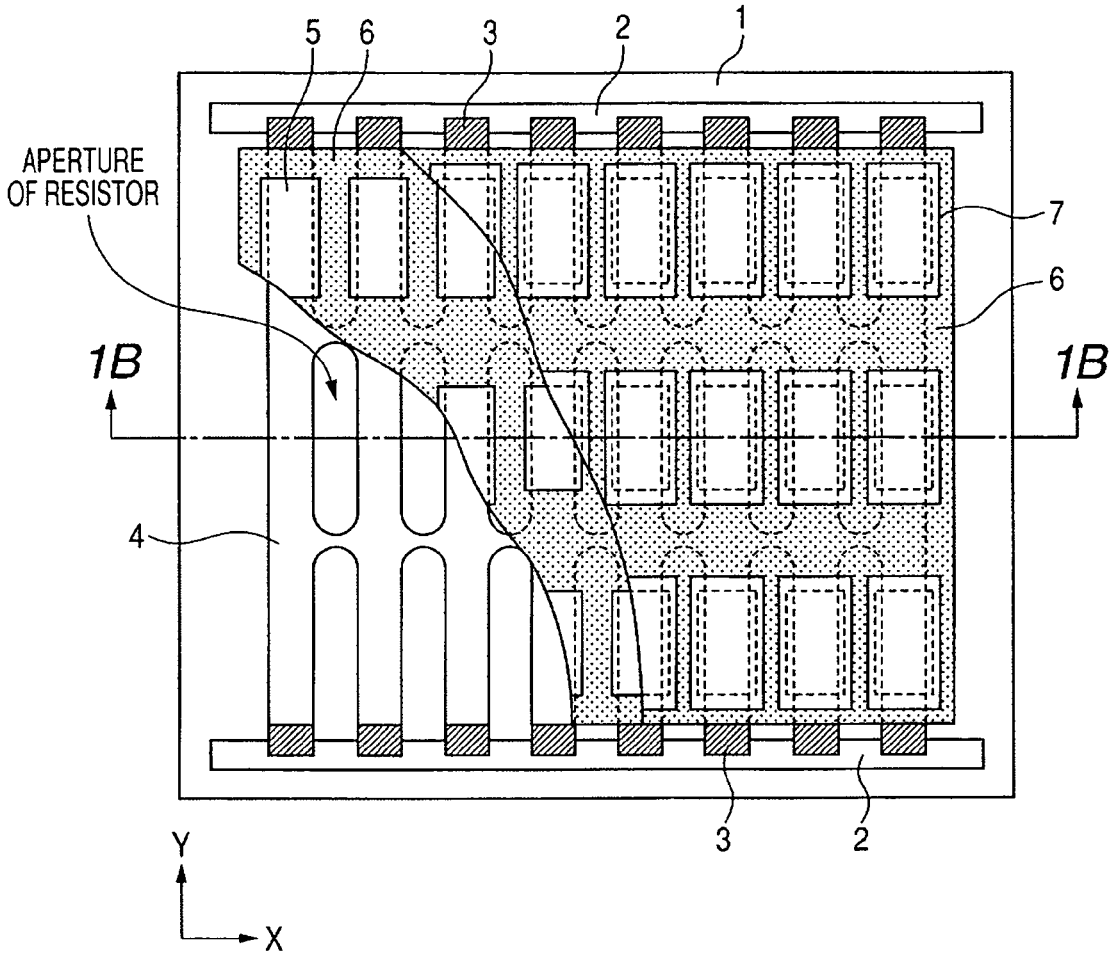
FIGS. 1A and 1B are respectively a cross-sectional view and a plan view schematically showing a configuration of a light emitting substrate in a first embodiment of the present invention.
Figure 1B:
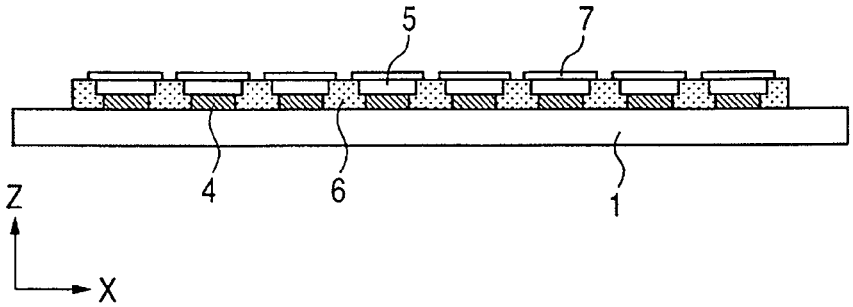

FIGS. 1A and 1B are schematic plan views showing configuration of a preferred embodiment of a light emitting substrate of the present invention, in which a part is cut off in order to clarify the positional relationship of components. In FIGS. 1A and 1B, there are shown a glass substrate 1, a common electrode 2, a connecting resistor 3, a resistor member 4 formed in a lattice shape, a phosphor 5 constituting a light emitting member of the present invention, a lattice-shaped black member 6, and a metal back 7 constituting an anode electrode. In the following, the lattice-shaped black member 6 will be represented as a black member.

In the present invention, each of the resistor member 4 and the black member 6 is formed in a lattice shape extending in X- and Y-directions, and the phosphor 5 is provided in an aperture of the black member 6. The metal back 7 is so positioned as to cover one or more phosphors 5, and each metal back 7 is electrically connected to the resistor member 4. In the present embodiment, a stripe portion of the resistor 4 extending in the Y-direction (Y-direction stripe portion) overlaps with the phosphor 5. Also an end of the resistor 4 extending in the Y-direction is connected through the connecting resistor 3 to the common electrode 2 formed in a peripheral portion of the glass substrate 1, and a high voltage is applied through a high-voltage terminal (not shown).

The metal backs 7 have a shape divided two-dimensionally in X- and Y-directions (arranged in a matrix), a gap of adjacent metal backs 7 is smaller in the X-direction than in the Y-direction. Also the resistor member 4 is not present in the gap of the metal backs 7 adjacent in the X-direction but is present at least a part of the gap of the metal backs 7 adjacent in the Y-direction.

In such configuration, a sheet resistance of the resistor member 4 is made lower than a sheet resistance of the black member 6 whereby a resistance between the metal backs 7 adjacent in the X- and Y-directions is defined by the resistor member 4. Also a breakdown voltage between the metal backs 7 can be improved by employing a black member 6 of a higher resistance in the gap of the metal backs 7 in the X-direction.

In case of an abnormal discharge, a potential difference of several hundred volts to several kilovolts is generated between the metal backs 7 adjacent in the X-direction, though it is dependent on an applied voltage and a resistance of the resistor member 4. A potential difference of about 500 V may be generated in case of employing a voltage application of 3 kV or higher for obtaining a bright image. Also assuming that a gap of the metal backs in the X-direction is about 100 μm at maximum, there may be employed a black member 6 having a breakdown voltage of $5\times10^6$ V/m or higher.

Within the resistor member 4, a stripe portion extending in the X-direction (X-direction stripe portion) overlaps, in parallel manner, with the black member 6, and is positioned within a width of the black member. Also a stripe portion extending in the Y-direction of the resistor 4 (Y-direction stripe portion) has to be provided in a position not overlapping with a gap of the metal backs adjacent in the X-direction. Stated differently, there is required such an arrangement that an aperture of the resistor overlaps with a gap of the metal backs. This is because the breakdown voltage is lowered if the resistor 4, having a lower resistance than the black member 6, is present between the metal backs 7 adjacent in the X-direction. In such configuration, a resistance between the metal backs 7 adjacent in the X-direction can be maintained high by a current path (by the resistor 4) longer than the gap of the metal back adjacent in the X-direction. Consequently the resistor 4 does not show an increase in the current density and is prevented from an electrical destruction.

The resistor 4 is electrically connected, through the connecting resistor 3, to the common electrode 2. Particularly in case of a television, since the distance is shorter in the Y-direction, it is preferable to connect the resistor member 4 extending in the Y-direction to the common electrode 2.

Figure 4A:
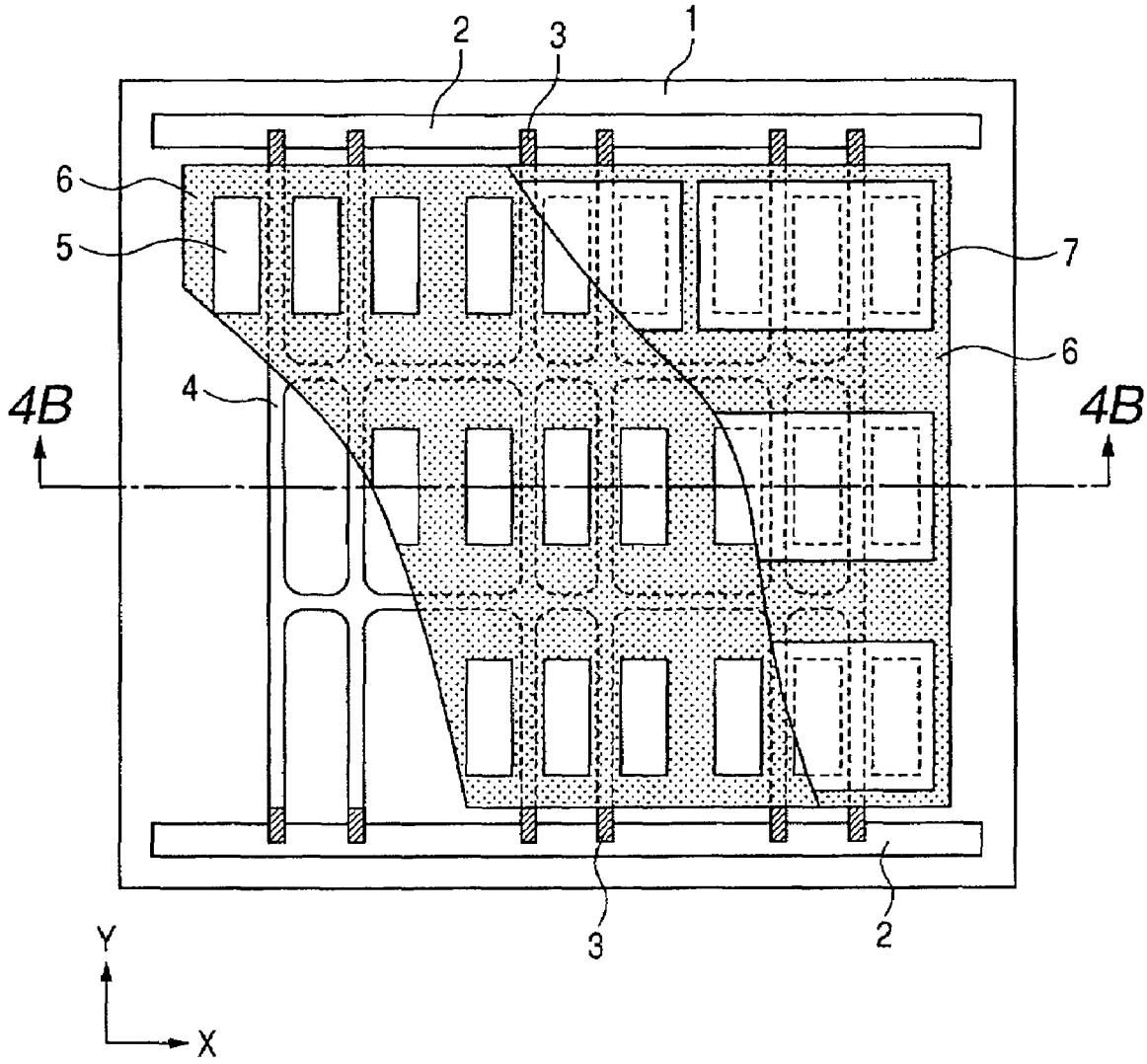
FIGS. 4A and 4B are views schematically showing a configuration of a light emitting substrate in a third embodiment of the present invention.
Figure 4B:
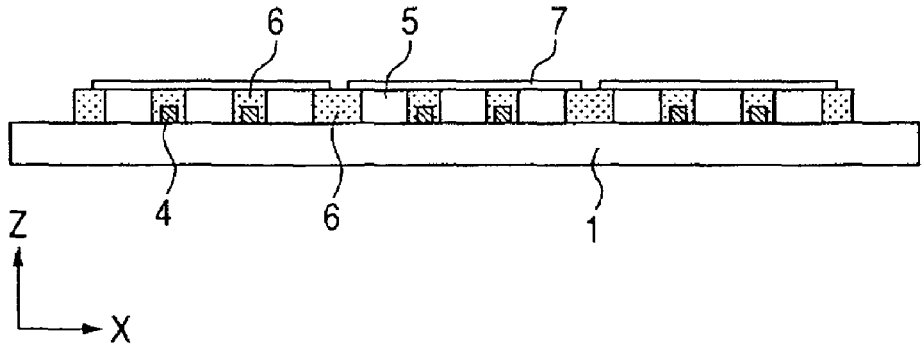

Each divided metal back 7 has to be connected to a portion, extending in the Y-direction, of the resistor 4, so that the number of the Y-direction stripe portions of the resistor 4 becomes equal to the number of divisions of the metal backs 7 in the X-direction. However, in case the Y-direction stripe portion of the resistor 4 is restricted in width, there may be employed plural (N) resistors for a same function, and, in such case as shown in FIGS. 4A and 4B, each metal back is connected to plural (N) Y-direction stripe portions of the resistor member 4.

Figure 5A:
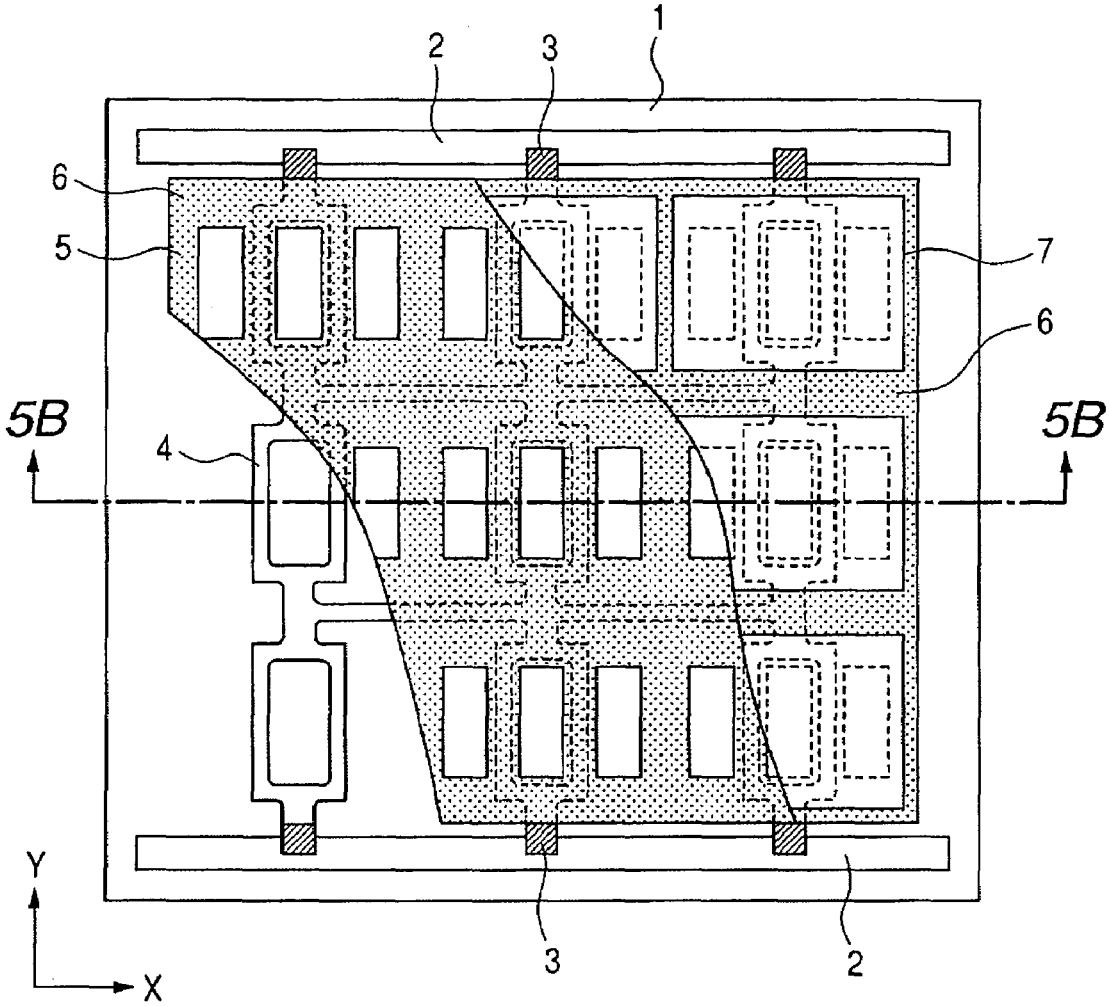
FIGS. 5A and 5B are views schematically showing a configuration of a light emitting substrate in a fourth embodiment of the present invention.
Figure 5B:
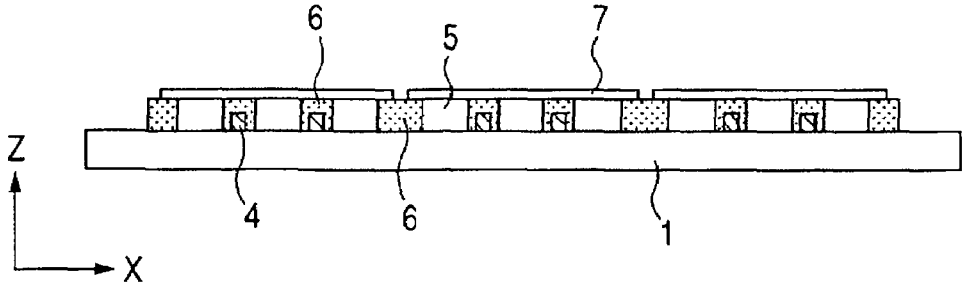

Also in case the resistor member 4 is constituted of an opaque material, it is undesirable to position the Y-direction stripe portion of the resistor 4 in superposition with the phosphor 5. In such case, as shown in FIGS. 4A and 4B, the Y-direction stripe portion of the resistor 4 is made narrower than the black member 6 positioned in superposition with the black member 6 in order to avoid an influence on the display. It is also possible, as shown in FIGS. 5A and 5B, to form an aperture in the Y-direction stripe portion of the resistor 4, positioned directly under the phosphor.

Figure 6A:
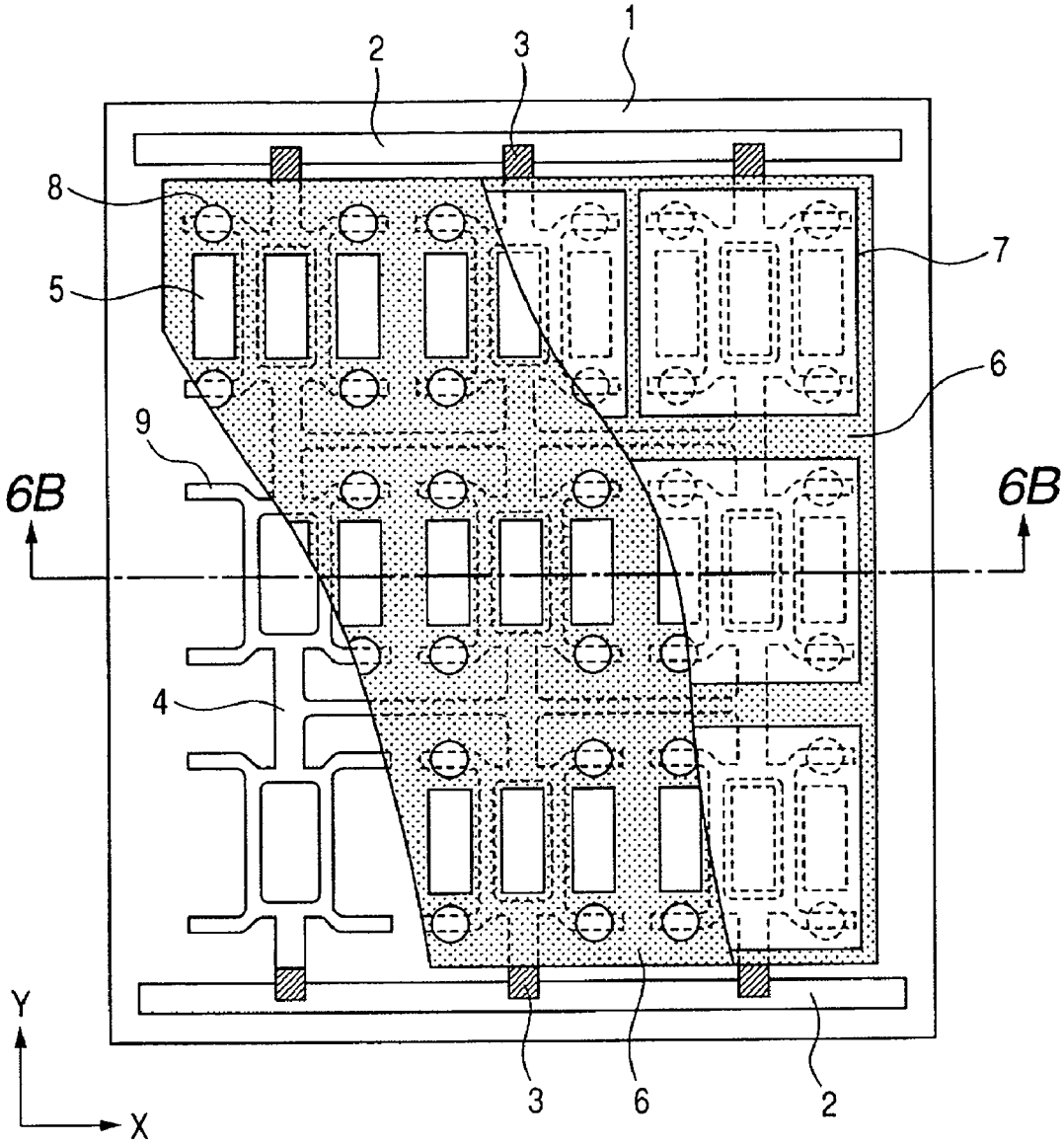
FIGS. 6A and 6B are views schematically showing a configuration of a light emitting substrate in a fifth embodiment of the present invention.
Figure 6B:
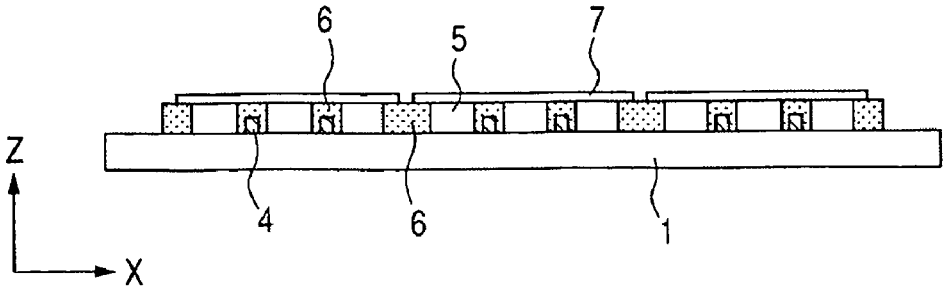
Figure 7:
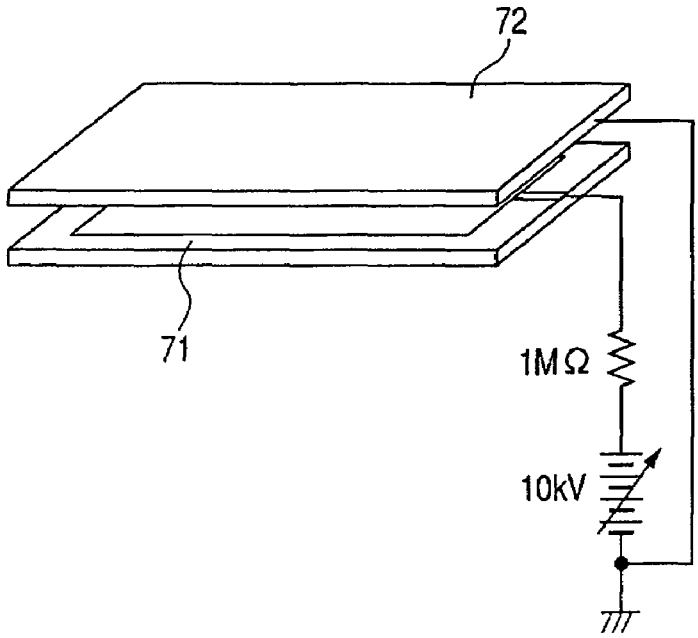
FIG. 7 is a schematic view showing a configuration of a prior image forming apparatus.
Figure 8:
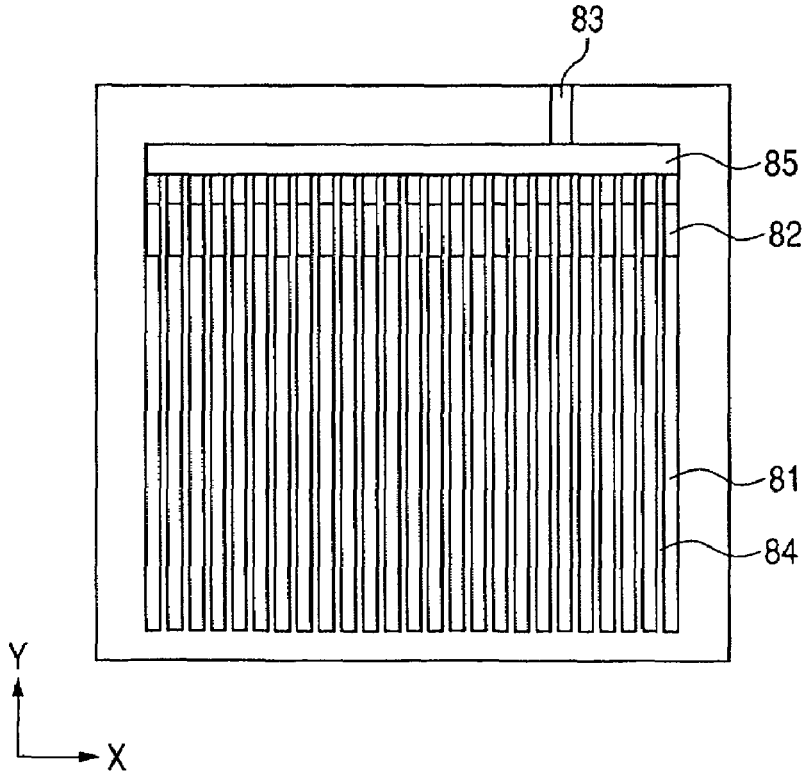
FIG. 8 is a schematic view showing a configuration of a prior light emitting substrate.
Figure 9:
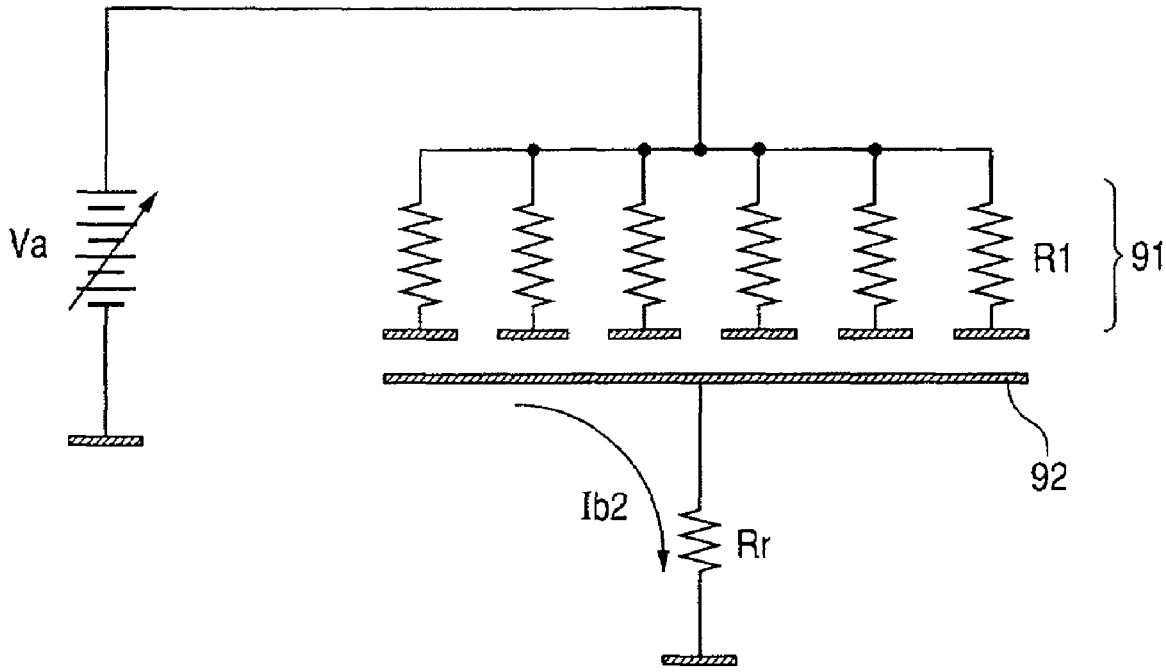
FIG. 9 is an equivalent circuit diagram of the light emitting substrate shown in FIG. 8.

The electrical connection between the metal back 7 and the resistor 4 is not particularly restricted. In FIGS. 1A, 1B, 3A, 3B, 4A, 4B, 5A and 5B, the electrical connection is made through the black member 6, but it is also possible to form an aperture in the black member 6 and electrically connect the metal back 7 and the resistor 4 through such aperture. Also the connection may be made through another conductive member if necessary. An example of such configuration will be explained with reference to FIGS. 6A and 6B. In FIGS. 6A and 6B, a Y-direction stripe portion of the resistor 4 is provided with a lead portion 9 protruding from such stripe portion. Also the black member 6 is provided with an aperture in an area corresponding to such lead portion 9. The aperture 8 is filled with a conductive material to achieve an electrical connection between the resistor 4 and the metal back 7. As the conductive material 8, ruthenium oxide of low resistance is employed preferably, but the present invention is not limited thereto.

The lattice-shaped resistor member 4 may be formed by any material capable of controlling a resistance, and, in case it is provided in superposition with the phosphor 5 as shown in FIGS. 1A and 1B, a transparent conductive film is preferable as it does not hinder the image display. In such case, there can be employed ITO or the like, preferably with a sheet resistance of 100 kΩ/square.

In the invention, one of the objects of utilizing the metal back 7 is to mirror reflect a light, emitted from the phosphor 5 and directed inwards, toward the glass substrate 1, thereby improving the luminance. Other objects include utilizing the metal back as an electrode for applying an accelerating voltage for the electron beam, and protecting the phosphor 5 from a damage by collision of anions, generated in an envelope 18 shown in FIG. 2 as will be explained later.

The divided metal back 7 may have a rectangular shape, but, in case of an abnormal discharge, a potential difference may be generated between the divided metal backs whereby an electric field is concentrated in a corner portion and may generate a creepage discharge. Consequently there is preferred a rectangular shape with rounded corners. A radius of curvature thereof is preferably selected larger for the purpose of avoiding discharge, but has to be determined in consideration of an irradiation area and a shape of the electron beam. In a surface conduction electron emitting device (SCE) employed in the present invention, since the electron beam has an arc shape, it is more preferable to employ a curvature matching such arc shape.

The metal backs 7 divided in the X- and Y-directions can be formed by forming a metal back 7 over the entire substrate bearing the phosphor 5 and executing a patterning by photoetching. There can also be employed a method of evaporation utilizing a metal mask having a desired aperture (called masked evaporation).

Furthermore, the metal back 7 is preferably divided in a unit of phosphors of red, green and blue, positioned in succession in the X-direction. In such case, the resistance of the resistor member 4 can be made higher because the current in the Y-direction stripe portion of the resistor member becomes smaller, whereby the discharge current can be further reduced. However, in consideration of the breakdown voltage between the metal backs 7 adjacent in the X-direction, there is preferred a division in the X-direction in a unit of two or more phosphors, preferably in a unit of a pixel formed by a set of red, green and blue phosphors. However the division may also be made in a unit of two or more pixels. FIGS. 1A and 1B show examples of division in the unit of a phosphor, and FIGS. 4A to 6B show examples of division in the unit of a pixel. Also the division in the Y-direction may be made in a unit of two or more pixels.

The lattice-shaped resistor member 4 may have a resistance not causing a significant luminance loss by a voltage drop in a driving state of the image forming apparatus. In case each electron emitting device has an emission current of 1 to 10 μA, the resistor member 4 preferably has a resistance of 1 kΩ to 1 GΩ. A practical upper limit of the resistance is determined in such a range that the voltage drop is 10% to a couple of 10% of the applied voltage and that an unevenness in the luminance is not generated. Also the breakdown voltage of the resistor member 4 is preferably $1\times10^6$ V/m or higher. Such breakdown voltage is estimated to be achieved when the resistor member 4 has a volumic resistivity of $1\times10^{-4}$ Ωcm or higher.

Also a crossing portion of the X-direction stripe portion and the Y-direction stripe portion of the lattice-shaped resistor member 4, easily causing a concentration of the electric field, preferably has a curvature as shown in FIGS. 1A and 1B. A radius of curvature is preferably made approximately same as a smaller width of the resistor member 4 extending in the X- and Y-directions, thereby saturating the concentration of the electric field and avoiding a secondary destruction in case of a discharge.

In FIGS. 1A and 1B, the connecting resistor 3, connecting the Y-direction stripe portion of the resistor member 4 and the common electrode 2 has a resistance preferably within a range from 10 kΩ to 1 GΩ and more preferably from 10 kΩ to 1 MΩ. It is thus rendered possible to limit the discharge current to the rear plate even in case a discharge is generated in the vicinity of the common electrode 2.

A sheet resistance of the black member 6 is required to be sufficiently higher than that of the resistor member 4, and is preferably 100 MΩ/square or higher. Also the black member 6 is required to have a high breakdown voltage. Specifically, there is required a breakdown voltage of $5\times10^6$ V/m or higher. More preferably a breakdown voltage of $4\times10^7$ V/m or higher allows to apply a higher voltage to the metal back, thereby obtaining an image of a high luminance. For obtaining such breakdown voltage, there is required a volumic resistivity of at least 100 Ωm, preferably 10 kΩ or higher.

The black member 6 may be formed, in addition to an ordinarily employed material principally constituted of graphite, by any material showing low transmission and reflection of light. The phosphor may be coated on the glass substrate 1 by a precipitation method or a printing method, both in case of a monochromatic display or a color display.

Figure 2:
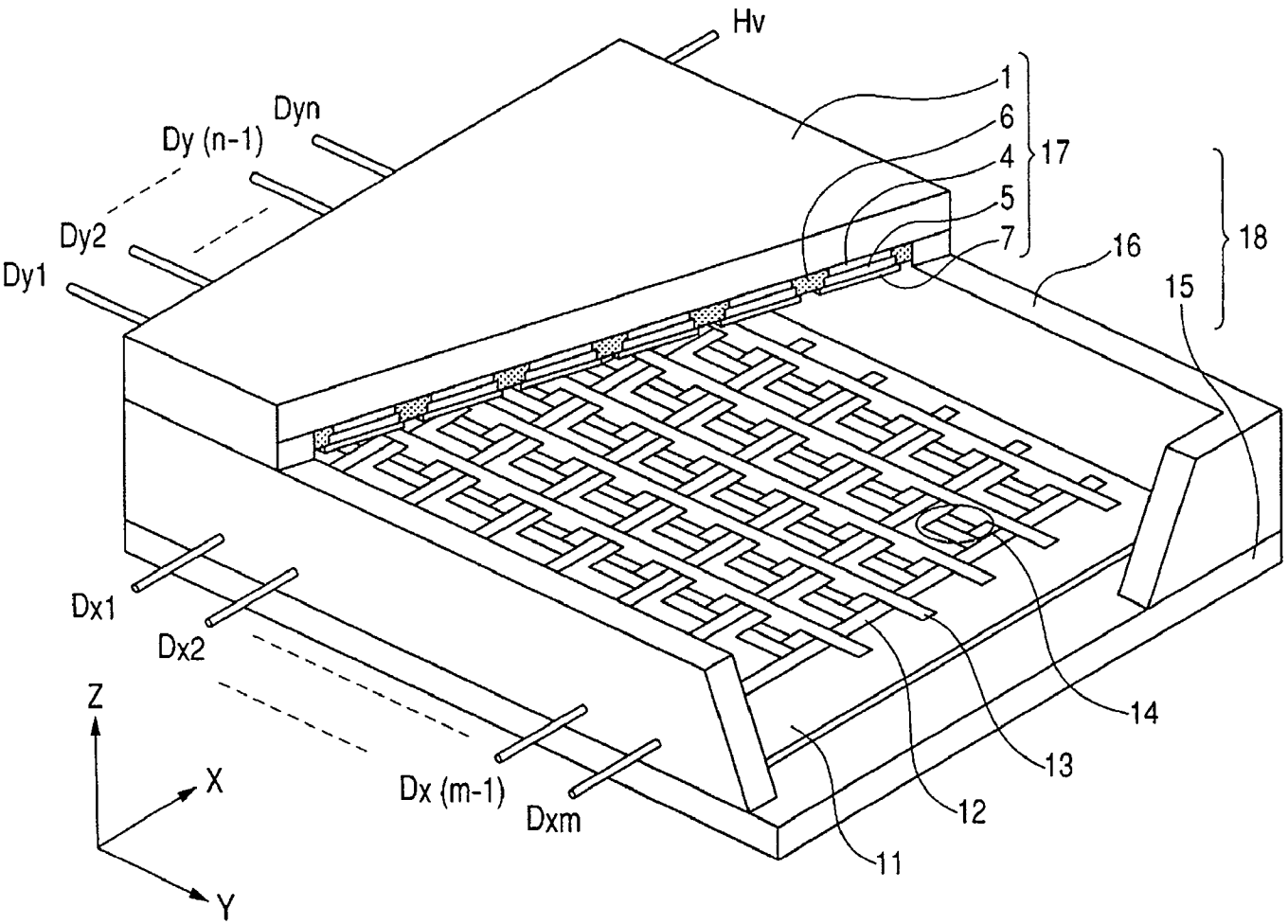
FIG. 2 is a perspective view schematically showing a configuration of a display panel in an embodiment of the image forming apparatus of the invention.

In the following, as an example of the image forming apparatus utilizing the light emitting substrate of the present invention, a configuration of an electron beam display panel will be explained with reference to FIG. 2. In FIG. 2, there are shown an electron source substrate 11 corresponding to a rear plate, a face plate 17 constituting an anode substrate corresponding to the light emission substrate of the present invention, a base member 15, and an outer frame 16, wherein the face plate 17, the base member 15 and the outer frame 16 constitute a vacuum envelope 18. Also an electron emitting device 14, a scanning wiring 12, and a signal wiring 13 are respectively connected to device electrodes of the electron emitting device 14. In case the substrate of the electron source substrate 11 has a sufficient strength, the outer frame 16 may be mounted directly on the substrate and the base member 15 may be dispensed with.

The scanning wiring 12 and the signal wiring 13 can be formed by coating silver paste by a screen printing method, or also by a photolithographic method. The scanning wiring 12 and the signal wiring 13 may be formed, in addition to the silver paste mentioned above, by various conductive materials. For example, in case of forming the scanning wiring 12 and the signal wiring 13 by a screen printing method, there may be employed a coating material formed by mixing a metal and a glass paste. Also in case of forming the scanning wiring 12 and the signal wiring 13 by precipitating a metal by a plating method, there may be employed a plating material. At a crossing point of the scanning wiring 12 and the signal wiring 13, there is provided an interlayer insulation layer (not shown).

For forming an image in such display panel, predetermined voltages are applied in succession to the scanning wirings 12 and the signal wirings 13 to selectively drive an electron emitting device 14 thereby irradiating the phosphor 5 with the emitted electrons to obtain a luminous point in a specified position. The metal back 7 is given a high voltage Hv to assume a higher potential than in the electron emitting device, in order to accelerate the emitted electrons and to obtain a luminous point of a higher luminance. The applied voltage is generally within a range from several hundred volts to several tends of kilovolts, though it also depends the performance of the phosphor 5. Therefore a distance between the rear plate 11 and the face plate 17 is usually selected within a range from 100 μm to several millimeters, in order not to cause a dielectric breakdown in the vacuum (namely a discharge) under such applied voltage.

Also in case of preparing an image forming apparatus utilizing the light emitting substrate of the present invention, a getter material may be provided in order to maintain a high vacuum in the envelope 18 over a prolonged period.

In such case, a getter material, if positioned in an area irradiated by the electrons emitted by the electron emitting devices, will lower the energy of the electron beam whereby a desired luminance cannot be attained. Therefore the getter material is preferably positioned avoiding the area irradiated by the electron beam. Also in order to increase an area of the getter, it is preferably formed on a rough surface.

EXAMPLES

Example 1

A light emitting substrate of a configuration shown in FIGS. 1A and 1B was prepared in a following procedure.

On a glass substrate 1, an ITO film was formed on an entire upper surface, and was formed into a lattice-shaped pattern by a photolithographic process to obtain a resistor member 4. Then patterned NiO films were formed as connecting resistors 3. Then a common electrode 2 was formed with an Ag paste, so as to be in contact with all the connecting resistors 3. Then, on the patterned ITO film, NP-7803 (manufactured by Noritake Kizai Co.) was printed as a black member 6, then red, green and blue phosphors 5 were coated and baked. Finally island-shaped metal backs 7 were formed by a vacuum evaporation method on the phosphor 5.

In the present example, there was employed a glass substrate PD200, manufactured by Asahi Glass Co., of a thickness of 2.8 mm. Also in the resistor member 4, the ITO film extending in the Y-direction had a width of 100 μm and a thickness of 100 nm, and the ITO film was regulated to a sheet resistance of 30 kΩ/square so as to obtain a resistance of about 120 kΩ between the metal backs 7 adjacent in the Y-direction. Also the ITO film extending in the X-direction had a width of 30 μm so as to obtain a resistance (individual resistance) of about 400 kΩ between the metal backs adjacent in the X-direction. In order not to perturb such resistance relationship, a sheet resistance of the black member 6 was regulated at $1\times10^{13}$ Ω/square (volumic resistivity: $1\times10^{8}$ Ωm, film thickness: 10 nm) which was sufficiently higher than that of the ITO. Also, as a high electric field is generated between the metal backs 7 adjacent in the X-direction in case of a discharge, the black member 6 had a breakdown voltage of $4\times10^{7}$ V/m.

The connecting resistor 3 had a resistance of 10 MΩ. In a crossing portion of the X-direction stripe portion of the resistor member 4 extending in the X-direction and the Y-direction stripe portion of the resistor member 4 extending in the Y-direction, since a current density increases in case of a discharge, a curvature was formed in order to relax the current concentration. In the present example, a radius of curvature was selected as 30 μm, matching the narrower stripe width in the X-direction. In this manner there was obtained a light emitting substrate (light emitting screen structure) as shown in FIGS. 1A and 1B, in which the components are so arranged that the gaps of the metal backs in the X-direction coincide with the apertures of the lattice-shaped resistor member 4.

An image forming apparatus shown in FIG. 2 was prepared by employing the light emitting substrate of the present example as a face plate 17. On a rear plate 11, a surface conduction electron-emitting device including a conductive film, having an electron emitting portion and connected between a pair of device electrodes, was positioned by N×M units on a substrate 11. These electron emitting devices were wired by M scanning wirings 12 and N signal wirings 13 respectively formed with a uniform pitch, thereby obtaining a multi electron beam source. In the present example, the scanning wirings 12 were positioned on the signal wirings 13 across an interlayer insulation film (not shown). The scanning wirings 12 receive scanning signals through lead terminals Dx1-Dxm, and the signal wirings 13 receive modulation signals (image signals) through lead terminals Dy1-Dyn.

The surface conduction electron emitting device was prepared by subjecting a conductive film to an electroforming and an electroactivation already known. The rear plate and the face plate, thus prepared, were sealed across an outer frame 16 to obtain an image forming apparatus. The electroforming process, the electroactivation process and the preparation of the image forming apparatus can be executed by a process described for example in Japanese Patent No. 3199682.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 250 V or less in a normal drive, and a decrease in the luminance was in a satisfactory level in a visual observation.

Example 2

Figure 3A:
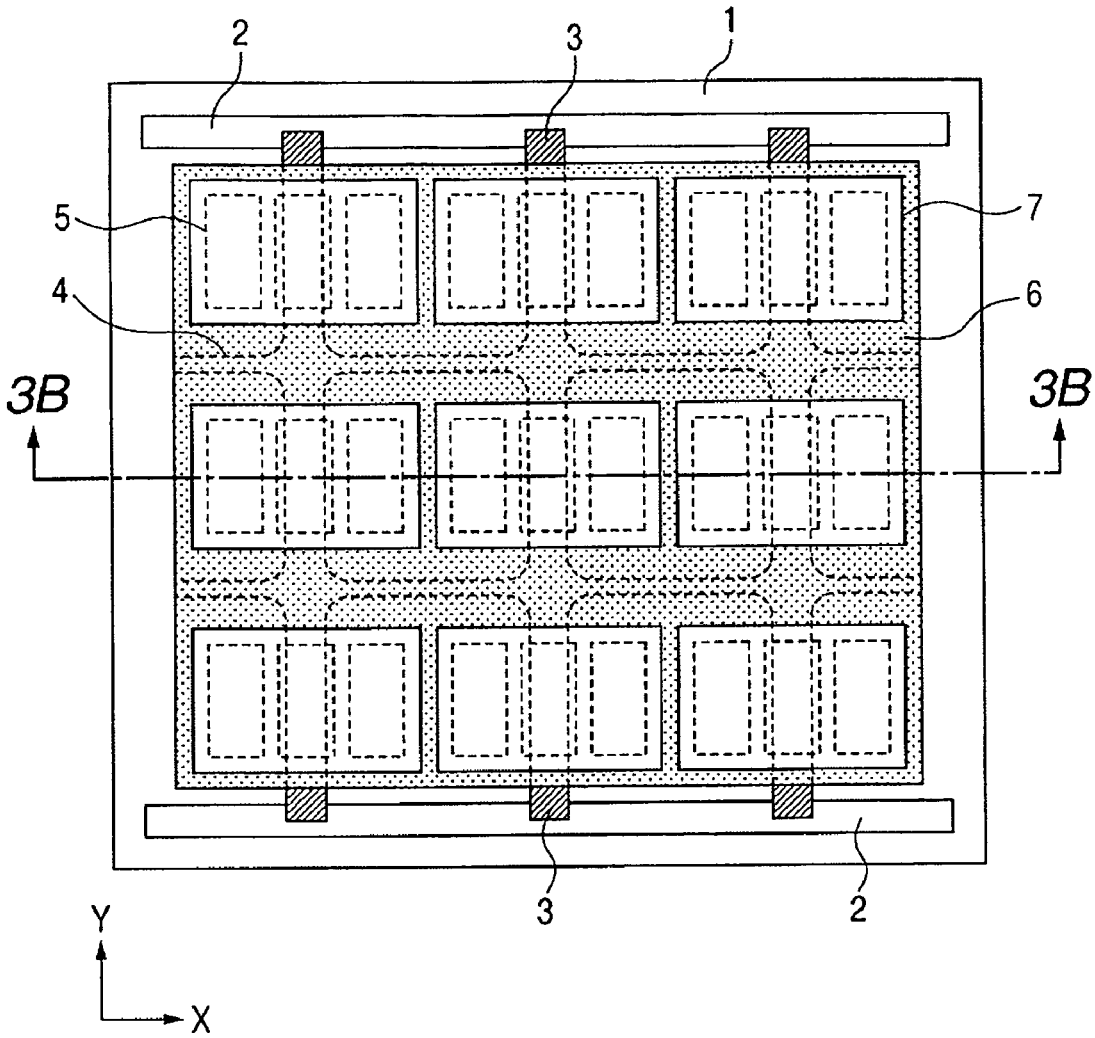
FIGS. 3A and 3B are views schematically showing a configuration of a light emitting substrate in a second embodiment of the present invention.
Figure 3B:
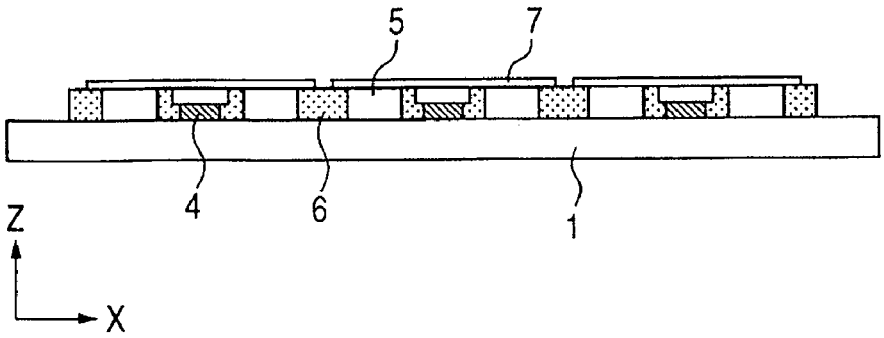

A light emitting substrate of a configuration shown in FIGS. 3A and 3B was prepared. This example was similar to Example 1 except that three phosphors 5 of red, green and blue arranged in succession in the X-direction were collectively covered by a single metal back 7.

In the present example, the Y-direction stripe portion of the ITO resistor extending in the Y-direction had a width of 100 μm and a thickness of 100 nm, and the ITO film was regulated to a sheet resistance of 30 kΩ/square so as to obtain a resistance of about 120 kΩ between the metal backs 7 adjacent in the Y-direction. Also the ITO film extending in the X-direction had a width of 50 μm so as to obtain a resistance (individual resistance) of about 800 kΩ between the metal backs adjacent in the X-direction. Also a crossing part of the lattice pattern of the resistance member 4 had a curvature of a radius of 50 μm, matching the narrower stripe width in the X-direction.

In this manner there was obtained a light emitting substrate (light emitting screen structure) as shown in FIGS. 3A and 3B, in which the components are so arranged that the gaps of the metal backs in the X-direction coincide with the apertures of the lattice-shaped resistor member 4.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

Example 3

A light emitting substrate of a configuration shown in FIGS. 4A and 4B was prepared. This example was similar to Example 2 except that the resistor member 4 was positioned under the black member 6 and that two Y-direction stripe portions of the resistor member 4, extending in the Y-direction, were provided per metal back.

In the present example, in the ITO resistor member, the Y-direction stripe portion had a width of 50 μm, and the ITO film was regulated to a sheet resistance of 30 kΩ/square so as to obtain a resistance of about 120 kΩ between the metal backs 7 adjacent in the Y-direction. Also the X-direction stripe portion of the ITO film had a width of 30 μm so as to obtain a resistance (individual resistance) of about 800 kΩ between the metal backs adjacent in the X-direction. Also a crossing part of the lattice pattern of the resistance member 4 had a curvature of a radius of 50 μm, matching the narrower stripe width in the X-direction.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

Example 4

A light emitting substrate of a configuration shown in FIGS. 5A and 5B was prepared. This example was similar to Example 2 except that an aperture was formed in the Y-direction stripe portion of the resistor member 4 positioned directly under the phosphor.

In the present example, the Y-direction stripe portion of the ITO resistor member 4 had a width of 50 μm in a portion corresponding to the phosphor (portion divided into two stripes), and a width of 100 μm in other portions.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

Example 5

A light emitting substrate of a configuration shown in FIGS. 6A and 6B was prepared. This example was similar to Example 4, except for forming a lead portion 9 protruding from the Y-direction stripe portion of the resistor member 4 extending in the Y-direction, forming an aperture in the black member 6 in a portion corresponding to the lead portion 9, and filling the aperture with a conductive material 8 thereby electrically connecting the resistor member 4 and the metal back 7 through such conductive material 8.

In the present example, in patterning the ITO formed on the entire surface of the glass substrate 1, the lead portion 9 was formed simultaneously. Then the black member 6 was printed with apertures, followed by a coating of the phosphor 5, a printing of the conductive material 8 by a printing method, and a baking. The conductive material 8 was constituted of ruthenium oxide.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

Example 6

A light emitting substrate was prepared in a similar manner as in Example 2, except that the metal back 7 in FIGS. 3A and 3B was further widened in the Y-direction to cover two pixels.

In the present example, the Y-direction stripe portion of the ITO resistor member, extending in the Y-direction had a width of 100 μm, and the ITO film was regulated to a sheet resistance of 60 kΩ/square so as to obtain a resistance of about 240 kΩ between the metal backs 7 adjacent in the Y-direction. Also the X-direction stripe portion of the ITO film had a width of 50 μm so as to obtain a resistance (individual resistance) of about 1.6 MΩ between the metal backs adjacent in the X-direction. Also a crossing part of the lattice pattern of the resistance member 4 had a curvature of a radius of 50 μm, matching the narrower stripe width in the X-direction.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

Example 7

A light emitting substrate was prepared in a similar manner as in Example 2, except that the metal back 7 in FIGS. 3A and 3B was further widened in the Y-direction to cover two pixels. Also the Y-direction stripe portion of the resistor member 4, extending in the Y-direction, was so positioned as to overlap with a third phosphor 5 among six phosphors arranged in the X-direction.

In the present example, the Y-direction stripe portion of the ITO resistor member, extending in the Y-direction had a width of 100 μm, and the ITO film was regulated to a sheet resistance of 30 kΩ/square so as to obtain a resistance of about 120 kΩ between the metal backs 7 adjacent in the Y-direction. Also the X-direction stripe portion of the ITO film had a width of 60 μm so as to obtain a resistance (individual resistance) of about 1.6 MΩ between the metal backs adjacent in the X-direction. Also a crossing part of the lattice pattern of the resistance member 4 had a curvature of a radius of 50 μm, matching the narrower stripe width in the X-direction.

An image forming apparatus as shown in FIG. 2 was prepared in the same manner as in Example 1, except for employing the light emitting substrate of this example as the face plate.

In a discharge resistance test conducted by lessoning the internal vacuum of this image forming apparatus, it could be confirmed that a current flowing in the face plate 17 and the rear plate 11 at a discharge was reduced in comparison with a configuration in which the metal back was not divided in the vertical and horizontal directions.

The image forming apparatus did not generate a point defect in the position of discharge and could maintain the state prior to the discharge.

Also the image forming apparatus showed a voltage drop of 275 V or less in a normal drive, and a decrease in the luminance was in a satisfactory level in a visual observation.

In the present invention, a conductor (metal back or anode electrode) is divided in the X- and Y-directions, and thus divided metal backs are electrically connected by a lattice-shaped resistor member. Therefore, even in case of an eventual discharge between the metal back and the electro emitting device, the potential difference between the adjacent metal backs can be suppressed by a control in the resistance of the resistor member. It is thus rendered possible to suppress a secondary discharge (discharge between the adjacent metal backs) resulting from a discharge generated between the metal back and the electron emitting device. Such secondary discharge means a shortcircuit between the adjacent metal backs, namely involving a charge supply from an adjacent metal back, thereby leading to an increase in the discharge current between the metal back and the electron emitting device. In the present invention, the adjacent metal backs are not completely insulated but are connected by a certain controlled resistance. Therefore, in case of an eventual discharge between the metal back and the electron emitting device, a weak current is induced between the adjacent metal backs, thereby suppressing a potential difference therebetween and preventing a shortcircuiting by the secondary discharge. In the present invention, since the metal backs adjacent in the X-direction have a narrower gap, no resistor is positioned between such adjacent metal backs. Stated differently, an arrangement is so made that the apertures of the lattice-shaped resistor member overlap with the gaps of the metal back in the X-direction. In the X-direction, a black member of a sufficiently high resistance is provided in the gap between the metal backs. Such configuration allows, while establishing a sufficient breakdown voltage between the adjacent metal backs, to achieve a high resistance between the metal backs adjacent in the X-direction, in comparison with a case where a resistor is present in the gap between the metal backs in the X-direction. It is thus rendered possible to establish a sufficient breakdown voltage while preventing an excessive current supply between the metal backs adjacent in the X-direction, thereby reducing the magnitude of the discharge between the metal back and the electron emitting device. Therefore, in such configuration, the discharge current is controlled by the resistance of the lattice-shaped resistor and is thus defined by the lattice-shaped resistor member (current-limiting resistor) whereby a desired effect of suppressing the discharge current can be attained.

Therefore, the image forming apparatus utilizing the light emitting screen structure (light emitting substrate) of the present invention can prevent an influence of an abnormal discharge on the electron emitting devices and an electrical destruction between the metal backs, and there can be provided an image forming apparatus of an excellent durability with a long service life.

This application claims priority from Japanese Patent Application No. 2004-334071 filed on Nov. 18, 2004, which is hereby incorporated by reference herein.

What is claimed is:

1. A light emitting screen structure comprising:

a substrate;

plural light emitting members positioned in a pattern of rows and columns on the substrate;

plural conductors each of which covers at least one of the light emitting members and which are arranged at an interval to form a pattern of rows and columns; and a resistor member electrically connecting the plural conductors;

wherein the resistor member is formed in a lattice shape including row stripe portions extending in a row direction, column stripe portions extending in a column direction, and aperture portions positioned between the row stripe portions and the column stripe portions, and a gap of the conductors adjacent in the row direction is positioned in an aperture of the lattice shaped resistor.

2. A light emitting screen structure according to claim 1, wherein a gap of the conductors adjacent in the row direction is smaller than a gap of the conductors adjacent in the column direction.

3. A light emitting screen structure according to claim 2, wherein the row stripe portion of the resistor member is positioned in a gap portion between the conductors adjacent in the column direction.

4. A light emitting screen structure according to claim 1, wherein the plural light emitting members are phosphors arranged at an interval so as to sandwich a black member between adjacent ones of the phosphors.

5. A light emitting screen structure according to claim 4, wherein the resistor member has a sheet resistance lower than a sheet resistance of the black member.

6. A light emitting screen structure according to claim 4, wherein the lattice-shaped resistor member is electrically connected with the conductors through an aperture provided in the black member.

7. A light emitting screen structure according to claim 1, wherein each of the plural conductors has a rectangular shape, with curvatures in corner portions thereof.

8. A light emitting screen structure according to claim 1, wherein the lattice-shaped resistor member is formed by a transparent resistor film.

9. A light emitting screen structure as claimed in claim 1, wherein the resistor member has a sheet resistance of 100 kΩ/square or less.

10. A light emitting screen structure as claimed in claim 1, wherein the resistor member has a volume resistivity of $1\times10^{-4}$ Ωm or higher.

11. A light emitting screen structure as claimed in claim 4, wherein the black member has a volume resistivity of 100 Ωm or higher.

12. A light emitting screen structure as claimed in claim 4, wherein the black member has a volume resistivity of 10 kΩ or higher.

13. A light emitting screen structure as claimed in claim 4, wherein the black member has a sheet resistance of 100 MΩ/square or higher.

14. An image forming apparatus including plural electron emitting devices, an electron source substrate having a wiring for applying a voltage to the electron emitting device, and a light emitting screen structure provided with a light emitting member which emits a light by an irradiation of electrons emitted by the electron emitting devices, wherein the light emitting screen structure has a structure described in claim 1.

* * * * *